US005545502A

United States Patent [19]

Ono et al.

[11] Patent Number: 5,545,502

[45] Date of Patent: Aug. 13, 1996

[54] ELECTROSTATIC IMAGE-DEVELOPING TONER

[75] Inventors: Hitoshi Ono; Noriaki Takahashi, both of Yokohama; Osamu Ando, Kawasaki; Masako Takeuchi, Yokohama; Hirofumi Oda, Chigasaki, all of Japan

[73] Assignee: Mitsubishi Chemical Corporation, Tokyo, Japan

[21] Appl. No.: 437,052

[22] Filed: May 9, 1995

Related U.S. Application Data

[63] Continuation of Ser. No. 165,890, Dec. 14, 1993, abandoned.

[30] Foreign Application Priority Data

Dec. 14, 1992 [JP] Japan ..... 4-333181
Jul. 14, 1993 [JP] Japan ..... 5-174294

[51] Int. Cl.[6] ..... G03G 9/097
[52] U.S. Cl. ..... 430/110
[58] Field of Search ..... 430/110, 106

[56] References Cited

U.S. PATENT DOCUMENTS 4,604,338 8/1986 Gruber et al. ..... 430/110
4,980,258 12/1990 Aoki et al. .
5,151,338 9/1992 Bayley et al. .
5,166,030 11/1992 Ono et al. ..... 430/110
5,320,924 6/1994 Shintaku et al. ..... 430/110
5,407,774 4/1995 Matsushima et al. ..... 430/110

FOREIGN PATENT DOCUMENTS 0511859 11/1992 European Pat. Off. .
4-125655 4/1992 Japan .
4-214571 8/1992 Japan .
4-269766 9/1992 Japan .
4-306665 10/1992 Japan .

*Primary Examiner*—Christopher D. Rodee
*Attorney, Agent, or Firm*—Oblon, Spivak, McClelland, Maier, & Neustadt, P.C.

[57] ABSTRACT

An electrostatic image-developing toner comprising at least a resin and a colorant, which further contains at least one compound of the following formula (I):

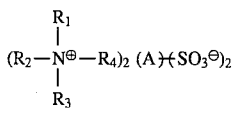

(I)

wherein $R_1$ is a $C_{1-24}$ substituted or unsubstituted alkyl group or a substituted or unsubstituted aralkyl group, each of $R_2$, $R_3$ and $R_4$ is a $C_{2-24}$ substituted or unsubstituted alkyl group or a substituted or unsubstituted aralkyl group, and A is an aromatic ring residue which may have substituents.

9 Claims, No Drawings

ELECTROSTATIC IMAGE-DEVELOPING TONER

This is a continuation of application Ser. No. 08/165,890, filed on Dec. 14, 1993, now abandoned.

The present invention relates to an electrostatic image-developing toner to be used for an electrophotographic copying machine or the like.

A developer for e.g. an electrophotographic copying machine is, in a developing step, once deposited on an image-carrier such as a photoreceptor on which an electrostatic image is formed, then in a transfer step, transferred from the photoreceptor to a transfer paper and then in a fixing step, fixed on a copying paper. Here, as the developer for developing the electrostatic image formed on the latent image-maintaining surface, a two-component developer comprising a carrier and a toner and a one-component developer (magnetic toner) requiring no carrier, are known.

As an agent for imparting an electric charge to the toner, a charge-controlling agent such as a Nigrosine dye or a quaternary ammonium salt, or a coating agent for the carrier, has, for example, been known (e.g. Japanese Unexamined Patent Publication No. 125655/1992, and U.S. Pat. 5,151,338).

However, these conventional charge-imparting agents did not necessarily have adequate charge-imparting effects, and they had problems such that the effects changed with time, whereby an image-staining was likely to result by a continuous copying operation, and the quality of the copied image tended to deteriorate.

Under these circumstances, the present inventors have conducted extensive studies to provide an electrostatic image-developing toner of high quality which is free from such a problem as a copied image-staining with time and, as a result, have found it possible to solve such a problem by incorporating a compound having a certain specific structure to the toner. The present invention has been accomplished on the basis of this discovery.

Thus, the present invention provides an electrostatic image-developing toner comprising at least a resin and a colorant, which further contains at least one compound of the following formula (I):

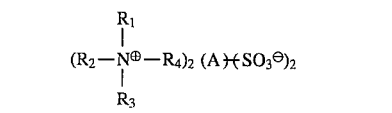

$$(R_2-\overset{\overset{R_1}{|}}{\underset{\underset{R_3}{|}}{N^{\oplus}}}-R_4)_2\,(A)(SO_3^{\ominus})_2 \qquad (I)$$

wherein $R_1$ is a $C_{1-24}$ substituted or unsubstituted alkyl group or a substituted or unsubstituted aralkyl group, each of $R_2$, $R_3$ and $R_4$ is a $C_{2-24}$ substituted or unsubstituted alkyl group or a substituted or unsubstituted aralkyl group, and A is an aromatic ring residue which may have substituents.

Now, the present invention will be described in detail with reference to the preferred embodiments.

The electrostatic image-developing toner of the present invention is characterized in that it contains at least one compound of the above formula (I).

Specific examples of the substituent $R_1$ include alkyl groups such as a methyl group, an ethyl group, a n-propyl group, an isopropyl group, a butyl group, a heptyl group, a hexyl group, an octyl group, a nonyl group, a decyl group, an undecyl group, a dodecyl group, a tridecyl group, a tetradecyl group, a pentadecyl group, a hexadecyl group, a heptadecyl group, a stearyl group, a nonadecyl group, an eicosyl group, a docosyl group and a tetracosyl group; substituted alkyl groups such as a hydroxyl-substituted alkyl group, a halogen-substituted alkyl group and an alkoxy-substituted alkyl group; aralkyl groups such as a benzyl group; and substituted aralkyl groups such as a lower alkyl-substituted benzyl group, a nitro-substituted benzyl group and a halogen-substituted benzyl group. Among them, a methyl group, an ethyl group, a benzyl group, a lower alkyl-substituted benzyl group, a halogen-substituted benzyl group or a nitro-substituted benzyl group is preferred.

Each of $R_2$, $R_3$ and $R_4$ may, for example, be an alkyl group such as an ethyl group, a n-propyl group, an isopropyl group, a n-butyl group, an isobutyl group, a tert-butyl group, a pentyl group, a hexyl group, a heptyl group, an octyl group, a nonyl group, a decyl group, a dodecyl group, a tridecyl group, a tetradecyl group, a pentadecyl group, a hexadecyl group, a heptadecyl group, a stearyl group, a nonadecyl group, an eicosyl group, a docosyl group or a tetracosyl group; a substituted alkyl group such as a hydroxyl-substituted alkyl group, a halogen-substituted alkyl group or an alkoxy-substituted alkyl group; an aralkyl group such as a benzyl group; or a substituted aralkyl group such as a lower alkyl-substituted benzyl group, a nitro-substituted benzyl group or a halogen-substituted benzyl group. Usually preferred is a $C_{2-16}$ unsubstituted alkyl group, a $C_{2-8}$ hydroxyl-substituted alkyl group or a benzyl group. Particularly preferred is a $C_{2-8}$ unsubstituted alkyl group.

A methyl group increases the water-solubility, and in the common synthesis as will be described hereinafter, the product will not precipitate in water even by the salt exchange. On the other hand, if only one of $R_2$, $R_3$and $R_4$ is an organic group having a large carbon number, the product tends to be insoluble in water and thus obtainable in the form of crystals, but the chargeability tends to be instable and the charge tends to increase as the number of copied sheets increases.

Each of $R_2$, $R_3$ and $R_4$ is preferably an alkyl group having at most 12 carbon atoms, and the difference in carbon number among $R_2$, $R_3$ and $R_4$ is not more than 4. It is particularly preferred that $R_2$, $R_3$ and $R_4$ are the same groups. Specifically, a butyl group, an octyl group, a decyl group or a dodecyl group is preferred, and particularly preferred is a n-butyl group or a n-octyl group.

A is an aromatic ring residue which may have substituents, and it may, for example, be a benzene ring residue, a naphthalene ring residue or an anthracene ring residue, preferably a benzene ring residue or a naphthalene residue, most preferably a naphthalene ring residue. Such an aromatic ring residue may have substituents. The substituent may, for example, be a lower alkyl group, a hydroxyl group, an amino group or a halogen atom. Particularly preferred among them is a hydroxyl group.

Among the compounds of the formula (I), those which are particularly suitable for incorporation to the electrostatic image-developing toner of the present invention include compounds having the following structural formulas. However, the compounds useful for the present invention are not limited to such specific examples.

Specific examples of the formula (I)

TABLE 1

| Compound No. | $R_1$ | $R_2$ | $R_3$ | $R_4$ | $[A+(-SO_3^{\ominus})_2$ |
|---|---|---|---|---|---|
| (1) | $-CH_3$ | $C_8H_{17}$ | $C_8H_{17}$ | $C_8H_{17}$ | m-benzenedisulfonic acid ion |
| (2) | $-CH_3$ | $C_{10}H_{21}$ | $C_{10}H_{21}$ | $C_{10}H_{21}$ | p-toluene-3,4-disulfonic acid ion |
| (3) | 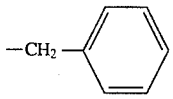 | $C_6H_{13}$ | $C_6H_{13}$ | $C_6H_{13}$ | 1,2-dihydroxybenzene-3,5-disulfonic acid ion |
| (4) | 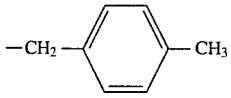 | $C_{12}H_{25}$ | $C_{12}H_{25}$ | $C_{12}H_{25}$ | 1,3-dihydroxybenzene-2,5-disulfonic acid ion |
| (5) | $-CH_3$ | $C_8H_{17}$ | $C_8H_{17}$ | $C_8H_{17}$ | 1,5-naphthalenedisulfonic acid ion |
| (6) | 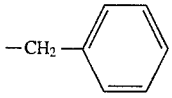 | $C_8H_{17}$ | $C_8H_{17}$ | $C_8H_{17}$ | 1,5-naphthalenedisulfonic acid ion |
| (7) | 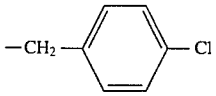 | $C_4H_9$ | $C_4H_9$ | $C_4H_9$ | 1,5-naphthalenedisulfonic acid ion |
| (8) | 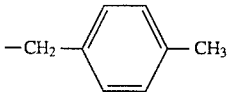 | $C_4H_9$ | $C_4H_9$ | $C_4H_9$ | 1,5-naphthalenedisulfonic acid ion |
| (9) | 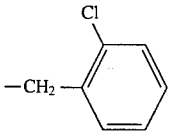 | $C_4H_9$ | $C_4H_9$ | $C_4H_9$ | 1,5-naphthalenedisulfonic acid ion |
| (10) | 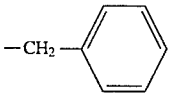 | $C_5H_{11}$ | $C_5H_{11}$ | $C_5H_{11}$ | 1,5-naphthalenedisulfonic acid ion |
| (11) | $-CH_3$ | $C_{10}H_{21}$ | $C_{10}H_{21}$ | $C_{10}H_{21}$ | 1,5-naphthalenedisulfonic acid ion |
| (12) | $-CH_3$ | $C_{12}H_{25}$ | $C_{12}H_{25}$ | $C_{12}H_{25}$ | 1,5-naphthalenedisulfonic acid ion |
| (13) | 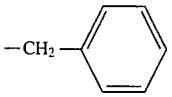 | $C_{16}H_{33}$ | $C_{16}H_{33}$ | $C_{16}H_{33}$ | 1,5-naphthalenedisulfonic acid ion |
| (14) | $-CH_3$ | $C_8H_{17}$ | $C_8H_{17}$ | $C_8H_{17}$ | 3-amino-1,5-naphthalenedisulfonic acid ion |
| (15) | 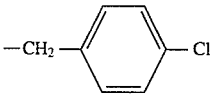 | $C_4H_9$ | $C_4H_9$ | $C_4H_9$ | 3-amino-1,5-naphthalenedisulfonic acid ion |
| (16) | 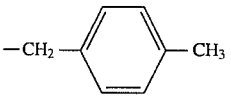 | $C_8H_{17}$ | $C_8H_{17}$ | $C_8H_{17}$ | 1,6-naphthalenedisulfonic acid ion |
| (17) | $-CH_3$ | $C_8H_{17}$ | $C_8H_{17}$ | $C_8H_{17}$ | 1,6-naphthalenedisulfonic acid ion |
| (18) | 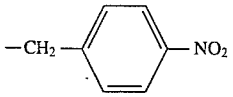 | $C_4H_9$ | $C_4H_9$ | $C_4H_9$ | 1,6-naphthalenedisulfonic acid ion |

TABLE 1-continued

| Compound No. | $R_1$ | $R_2$ | $R_3$ | $R_4$ | $[A]-(SO_3^{\ominus})_2$ |
|---|---|---|---|---|---|
| (19) | 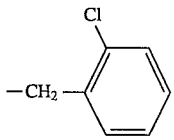 | $C_4H_9$ | $C_4H_9$ | $C_4H_9$ | 1,6-naphthalenedisulfonic acid ion |
| (20) | $-CH_3$ | $C_{14}H_{29}$ | $C_{14}H_{29}$ | $C_{14}H_{29}$ | 2-naphthol 6,8-disulfonic acid ion |
| (21) | 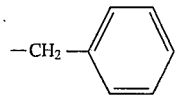 | $C_8H_{17}$ | $C_8H_{17}$ | $C_8H_{17}$ | 2-naphthol 6,8-disulfonic acid ion |
| (22) | 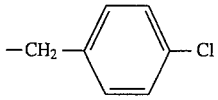 | $C_4H_9$ | $C_4H_9$ | $C_4H_9$ | 2-naphthol 6,8-disulfonic acid ion |
| (23) | 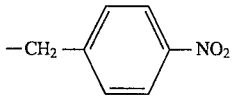 | $C_8H_{17}$ | $C_8H_{17}$ | $C_8H_{17}$ | 1-amino-8-hydroxy-2,4-naphthalenedisulfonic acid ion |
| (24) | 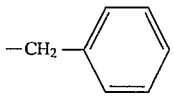 | $C_8H_{17}$ | $C_8H_{17}$ | $C_8H_{17}$ | 2,6-naphthalenedisulfonic acid ion |
| (25) | $C_2H_5$ | $C_8H_{17}$ | $C_8H_{17}$ | $C_8H_{17}$ | 2,6-naphthalenedisulfonic acid ion |
| (26) | 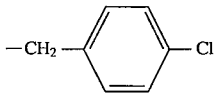 | $C_{10}H_{21}$ | $C_{10}H_{21}$ | $C_{10}H_{21}$ | 1-naphthol-8-hydroxy 3,6-naphthalenedisulfonic acid ion |
| (27) | 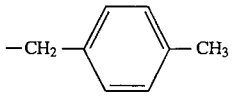 | $C_4H_9$ | $C_4H_9$ | $C_4H_9$ | 1-naphthol-8-hydroxy 3,6-naphthalenedisulfonic acid ion |
| (28) | $-CH_3$ | $C_8H_{17}$ | $C_8H_{17}$ | $C_8H_{17}$ | 7-amino-1,5-naphthalenedisulfonic acid ion |
| (29) | 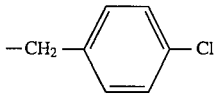 | $C_4H_9$ | $C_4H_9$ | $C_4H_9$ | 7-amino-1,5-naphthalenedisulfonic acid ion |
| (30) | 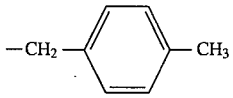 | $C_4H_9$ | $C_4H_9$ | $C_4H_9$ | 7-amino-1,5-naphthalenedisulfonic acid ion |
| (31) | 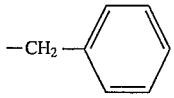 | $C_8H_{17}$ | $C_8H_{17}$ | $C_8H_{17}$ | 7-amino-1,5-naphthalenedisulfonic acid ion |
| (32) | $-CH_3$ | $-CH_2-$ | $-CH_2-$ | $-CH_2-$ | 1,5-naphthalenedisulfonic acid ion |
| (33) | 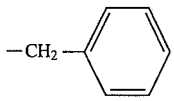 | $-CH_2-$ | $-CH_2-$ | $-CH_2-$ | 1,5-naphthalenedisulfonic acid ion |
| (34) | 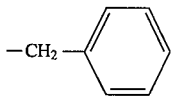 | $C_4H_9$ | $C_4H_9$ | $-CH_2CH(C_2H_5)C_4H_9$ | 1,5-naphthalenedisulfonic acid ion |

TABLE 1-continued

| Compound No. | $R_1$ | $R_2$ | $R_3$ | $R_4$ | $[A]-(SO_3^{\ominus})_2$ |
|---|---|---|---|---|---|
| (35) | $-CH_2-$ 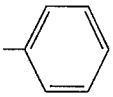 | $-CH(CH_3)_2$ | $-CH(CH_3)_2$ | $C_2H_5$ | 1,5-naphthalenedisulfonic acid ion |
| (36) | $-CH_2-$ 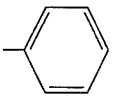 | $-C_2H_5$ | $-C_2H_5$ | $-C_{14}H_{29}$ | 1,5-naphthalenedisulfonic acid ion |
| (37) | $-CH_2-$ 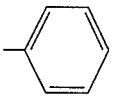 | $C_{12}H_{25}$ | $CH_2CH_2OH$ | $CH_2CH_2OH$ | 1,5-naphthalenedisulfonic acid ion |
| (38) | $-CH_2-$ 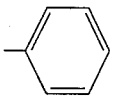 | $-C_8H_{17}$ | $-C_8H_{17}$ | $-C_8H_{17}$ | 1,5-naphthalenedisulfonic acid ion |

The compound of the formula (I) can be used for the present invention, irrespective of the method for its preparation. However, a specific method for its preparation will be described as an example.

The compound of the formula (I) can be obtained preferably by a method which comprises reacting a tertiary amine and an alkyl halide or an aralkyl halide in the presence of a compound of the formula (II);

$$R_5—OH \qquad (II)$$

wherein $R_5$ is a substituted or unsubstituted alkyl group, to obtain a halogenated quaternary ammonium salt compound of the formula (III);

$$[R_1—\overset{\overset{R_2}{|}}{\underset{\underset{R_3}{|}}{N^{\oplus}}}—R_4]\,X^{\ominus} \qquad (III)$$

wherein $R_1$, $R_2$, $R_3$ and $R_4$ are as defined above with respect to the formula (I), and $X^{\ominus}$ is a halogen ion such as chlorine or bromine, and then reacting the halogenated quaternary ammonium salt compound with an organic acid metal salt or an organic salt of the formula (IV);

$$Y_2^{\oplus}[A]-(SO_3^{\ominus})_2 \qquad (IV)$$

wherein A is as defined above with respect to the formula (I), and Y is an alkali metal such as sodium or potassium by heating them in water or in an alcohol at a temperature of from 50° to 70° C.

In the reaction to obtain the halogenated quaternary ammonium salt compound of the formula (III), it is preferred to add water and an aromatic or halogenated organic solvent after substantial completion of the reaction, followed by removal of the organic solvent layer.

The substituent $R_5$ may, for example, be an alkyl group such as a methyl group, an ethyl group, a n-propyl group, an isopropyl group, a butyl group or a pentyl group; or a substituted alkyl group such as a halogen-substituted alkyl group or an alkoxy-substituted alkyl group. Among them, an alkyl group, particularly a $C_{1-5}$ alkyl group, is preferred.

The aromatic or halogenated organic solvent may be any solvent so long as it has a small solubility with water, it does not dissolve the quaternary ammonium compound of the above formula (IV) and it has a suitable boiling point. Specifically, it may, for example, be an aromatic organic solvent such as toluene, ethylbenzene or xylene, or a halogenated organic solvent such haloform, trihaloethane, trihaloethylene or halobenzene. Among them, toluene, chloroform, 1,1,1-trichloroethane, trichloriethylene or chlorobenzene is preferred, and toluene or chlorobenzene is particularly preferred.

The compound of the above formula (II) is used usually in an amount of from 0.1 to 100 mols, preferably from 2 to 20 mols, per mol of the tertiary amine. If the amount of the compound of the formula (II) is small, the reaction may not proceed effectively. On the other hand, if the amount is too much, it tends to be difficult to recover the halogenated quaternary ammonium salt compound of the formula (III) from the reaction system.

The alkyl halide or the aralkyl halide is used usually in an amount of from 0.8 to 10 mols, preferably from 0.9 to 2 mols, per mol of the tertiary amine.

The method for mixing the tertiary amine, the alkyl halide or the aralkyl halide and the compound of the formula (II) may, for example, be ① a method wherein the tertiary amine is firstly mixed with the compound of the formula (II) and then the alkyl halide or the aralkyl halide is reacted thereto, or ② a method wherein the alkyl halide or the aralkyl halide is firstly mixed with the compound of the formula (II), and then the tertiary amine is reacted thereto. By the presence of the compound of the formula (II), the reactivity of the tertiary amine with the alkyl halide or the aralkyl halide can be remarkably improved. Further, it possible to conduct the reaction in the presence of a compound having a polarity such as acetonitrile, in addition to the compound of the formula (II). Further, in order to improve the reactivity, the reaction system may be heated. There is no particular restriction to the timing when the heating should be started. However, it is preferred to start the heating after mixing at least two compounds among the tertiary amine, the alkyl halide or the aralkyl halide and the compound of the formula (II). The reaction temperature is preferably at most 100° C., particularly preferably at most 80° C. The reaction time is not particularly limited, although it depends upon the reaction temperature, and it is usually preferably from 0.5 to 20 hours, particularly preferably from 1 to 10 hours.

With respect to the amounts of the water and the aromatic or halogenated organic solvent to be used after obtaining the halogenated quaternary ammonium salt compound of the formula (III) by the above reaction, the water is usually in an amount of from 10 to 500 mols, preferably from 50 to 200 mols, and the organic solvent is usually in an amount of from 0.1 to 10 mols, preferably from 0.5 to 5 mols, per mol of the tertiary amine. The halogenated quaternary ammonium salt compound of the formula (III) is contained in the aqueous layer, while unreacted compounds such as the tertiary amine and the alkyl halide or the aralkyl halide, and impurities such as hydrolysates of the alkyl halide or the aralkyl halide, are contained in the organic solvent layer. It is, therefore, possible to obtain an aqueous solution of the halogenated quaternary ammonium salt compound of the formula (III) by removing the organic solvent layer.

The halogenated quaternary ammonium salt compound of the formula (III), thus obtained, will then be contacted with the organic acid or the metal salt of the organic acid of the above formula (IV) in a liquid phase to obtain the compound of the formula (I). The contacting method may, for example, be (1) a method wherein an aqueous solution of the organic acid or the metal salt of the organic acid of the formula (IV), is added to the solution of the halogenated quaternary ammonium salt compound of the formula (III), or (2) a method wherein a solution of the halogenated quaternary ammonium salt compound of the formula (III) is added to an aqueous solution of the organic acid or the metal salt of the organic acid of the formula (IV).

Further, the presence of the compound of the formula (II) in the aqueous solution during the precipitation, provides effects to prevent precipitation of impurities. At the time of the above contact, the compound of the formula (II) may be added to the system. The solution may be acidic, alkaline or neutral, but it is preferably neutral (pH 6 to 8). The pH can be adjusted with a weak acid, a weak base or the like.

The reaction temperature is usually at most 70° C., preferably at most 60° C. The reaction time is not particularly limited, although it depends on the reaction temperature. It is preferably from 0.5 to 20 hours, particularly preferably from 1 to 10 hours.

Among compounds of the formula (I), those having a substituted or unsubstituted benzyl group, may have water of crystallization. The following methods may, for example, be mentioned for drying such compounds of the formula (I).

(1) Method for obtaining crystals containing water of crystallization An excess solvent other than water of crystallization is removed by drying at a low temperature under a low vacuum condition.

(2) Method for obtaining crystals containing no water of crystallization

The crystals obtained in the above method (1) are dried at a high temperature under a high vacuum condition. Otherwise, the wet cake obtained by synthesis is dried at a high temperature under a high vacuum condition from the beginning.

The temperature and the degree of vacuum in the method (1) are usually from 20° to 50° C. and from 40 to 500 mmHg, preferably from 30° to 40° C. and from 50 to 100 mmHg, respectively. Further, the time for drying is usually from 0.5 to 10 hours, preferably from 1 to 3 hours, although it depends upon e.g. the temperature and the degree of vacuum.

The temperature and the degree of vacuum in the method (2) are usually from 50° to 100° C. and from 40 to 0.01 mmHg, preferably from 55° to 90° C. and from 30 to 1 mmHg. The time for drying is usually from 0.5 to 10 hours, preferably from 1 to 7 hours.

Specific examples of the organic acid or the metal salt of the organic acid to be used, include 1,5-naphthalenedisulfonic acid, sodium 1,5-naphthalenedisulfonate, 1-naphthol-4-sulfonic acid, and sodium 1-naphthol-4sulfonate As the resin component useful for the present invention, conventional various resins suitable for an electrostatic image-forming developing toner, may be mentioned. For example, a styrene resin, a styrene-acrylate copolymer, a polyester resin., an epoxy resin or a mixture thereof, or such resins having amino groups in their alkyl side chains, may be mentioned.

The content of the compound of the formula (I) in the toner is preferably from 0.1 to 20 parts by weight, more preferably from 1 to 15 parts by weight, per 100 parts by weight of the resin.

If the content of the compound of the formula (I) is too small, no adequate effects for improving the chargeability can be expected. On the other hand, if it is excessive, the quality of the toner tends to deteriorate, such being undesirable.

The colorant to be used in the present invention, is not particularly limited so long as it is the one commonly employed. To obtain a black toner, carbon black or the like may be used. The compound of the formula (I) is usually white and may be incorporated to a color toner of e.g. blue, red or yellow. In such a case, a colorant composed of a dye or pigment having the corresponding color, may be employed.

The content of the colorant is preferably from 3 to 20 parts by weight per 100 parts by weight of the resin.

Further, the toner of the present invention may contain, in addition to the compound of the formula (I), other charge-controlling agents inclusive of conventional agents, such as a Nigrosine dye, a quaternary ammonium salt and a polyamine resin.

Furthermore, to improve the fixing property or flowability, an additive such as a lower molecular weight olefin polymer or fine silica powder may be incorporated as a constituting component of the toner of the present invention.

For the preparation of the toner, the above various components may be kneaded by a kneader and then cooled, followed by pulverization and classification. The toner of the present invention may be applied not only to a two-component developer but also to an encapsulated toner, a polymerized toner and a so-called one-component developer (magnetic toner) such as a magnetite-containing toner.

The average particle size of the toner is preferably to from 5 to 20 μm. As a carrier to be mixed with the toner of the present invention to form a developer, an iron powder having an average particle size of from 10 to 200 μm, is preferred, although there is no particular restriction as to the carrier. There is no particular restriction to the particle size of such an iron powder. For the purpose of improving the durability for continuous use, a so-called coating carrier having a fluorine or silicone resin coated thereon, may also be used. Further, other conventional carriers including a ferrite-type carrier and a magnetite-type carrier may also be used. Such a carrier is used preferably in an amount of from 5 to 100 parts by weight per part by weight of the toner.

Now, the present invention will described in further detail with reference to Examples. However, it should be understood that the present invention is by no means restricted by such specific Examples.

In the following Examples, "parts" means "parts by weight".

EXAMPLE 1

| | |
|---|---|
| Styrene-acrylate resin (Styrene/acrylate = 8/2) | 100 parts |
| Carbon black (MA-100 manufactured by Mitsubishi Kasei corporation) | 6 parts |
| Low molecular weight polyethylene | 1 part |
| Low molecular weight polypropyrene | 1 part |
| Compound No. 8 | 2 parts |

The above materials were blended, kneaded, pulverized and classified to obtain a black toner having an average particle size of 11 μm.

To 100 parts of this toner, 0.2 part of hydrophobic silica was mixed to obtain a toner.

Four parts of this toner and 100 parts of a silicon resin-coated carrier (ferrite) having an average particle size of 100 μm were mixed and stirred to obtain a developer. Then, this developer was used for actual copying by a copying machine employing an organic photoconductor as a photoreceptor, whereby a clear copy was obtained with little stain of the white background as so-called fogging. The initial image density was 1.37, the fogging was 0.84, and the electric charge was 15.3 μc/g. Further, a copying test of 100,000 sheets was carried out, whereupon the image density was the same as the initial stage at a level of 1.37, the fogging was as low as 0.87, and the electric charge was 18.5 μc/g.

EXAMPLE 2

The test was conducted in the same manner as in Example 1 except that a silicone resin-coated carrier having an average particle size of 100 μm with magnetite cores was used as the coated carrier, whereby a clear copy was obtained as in Example 1. The initial electric charge and the electric charge after copying 100,000 sheets were 14 μc/g and 19 μc/g, respectively. The image density was 1.35 at the initial stage as well as after copying 100,000 sheets.

EXAMPLE 3

The test was conducted in the same manner as in Example 1 except that a fluorine resin-coated carrier having an average particle size of 70 μm with iron cores, was used as the coated carrier, whereby a clear copy was obtained as in Example 1.

EXAMPLE 4

| | |
|---|---|
| Styrene resin (SBM-600, manufactured by Sanyo Kasei KK) | 100 parts |
| Carbon black (#44, manufactured by Mitsubishi Kasei corporation) | 10 parts |
| Compound No. 1 | 3 parts |

The above materials were blended, kneaded, pulverized and classified to obtain a black toner having an average particle size of 11 μm.

Five parts of this toner and 100 parts of a silicon resin-coated carrier (ferrite) having an average particle size of about 100 μm, were mixed and stirred to obtain a developer. Then, this developer was used for actual copying by a copying machine employing an organic photoconductor as a photoreceptor, whereby a clear copy was obtained with little stain of the white background as so-called fogging.

EXAMPLE 5

The test was conducted in the same manner as in Example 4 except that 3 parts of compound No. 4 was used instead of 3 parts of compound No. 1 as the charge-controlling agent, whereby a clear copy was obtained as in Example 4.

EXAMPLE 6

The test was conducted in the same manner as in Example 4 except that 2 parts of compound No. 5 was used instead of 3 parts of compound No. 1 as the charge-controlling agent, whereby a clear copy was obtained as in Example 4.

EXAMPLE 7

The test was conducted in the same manner as in Example 4 except that 2 parts of compound No. 6 was used instead of 3 parts of compound No. 1 as the charge-controlling agent, whereby a clear copy was obtained as in Example 4.

EXAMPLE 8

The test was conducted in the same manner as in Example 4 except that 2 parts of compound No. 7 was used instead of 3 parts of compound No. 1 as the charge-controlling agent, whereby a clear copy was obtained as in Example 4.

EXAMPLE 9

The test was conducted in the same manner as in Example 4 except that 2 parts of compound No. 8 was used instead of 3 parts of compound No. 1 as the charge-controlling agent, whereby a clear copy was obtained as in Example 4.

EXAMPLE 10

The test was conducted in the same manner as in Example 4 except that 2 parts of compound No. 9 was used instead of 3 parts of compound No. 1 as the charge-controlling agent, whereby a clear copy was obtained as in Example 4.

EXAMPLE 11

The test was conducted in the same manner as in Example 4 except that 3 parts of compound No. 10 was used instead of 3 parts of compound No. 1 as the charge-controlling agent, whereby a clear copy was obtained as in Example 4.

EXAMPLE 12

The test was conducted in the same manner as in Example 4 except that 3 parts of compound No. 12 was used instead of 3 parts of compound No. 1 as the charge-controlling agent, whereby a clear copy was obtained as in Example 4.

EXAMPLE 13

The test was conducted in the same manner as in Example 4 except that 2 parts of compound No. 14 was used instead of 3 parts of compound No. 1 as the charge-controlling agent, whereby a clear copy was obtained as in Example 4.

EXAMPLE 14

The test was conducted in the same manner as in Example 4 except that 2 parts of compound No. 15 was used instead of 3 parts of compound No. 1 as the charge-controlling agent, whereby a clear copy was obtained as in Example 4.

EXAMPLE 15

The test was conducted in the same manner as in Example 4 except that 3 parts of compound No. 17 was used instead of 3 parts of compound No. 1 as the charge-controlling agent, whereby a clear copy was obtained as in Example 4.

EXAMPLE 16

The test was conducted in the same manner as in Example 4 except that 3 parts of compound No. 19 was used instead of 3 parts of compound No. 1 as the charge-controlling agent, whereby a clear copy was obtained as in Example 4.

EXAMPLE 17

The test was conducted in the same manner as in Example 4 except that 2 parts of compound No. 21 was used instead of 3 parts of compound No. 1 as the charge-controlling agent, whereby a clear copy was obtained as in Example 4.

EXAMPLE 18

The test was conducted in the same manner as in Example 4 except that 2 parts of compound No. 22 was used instead of 3 parts of compound No. 1 as the charge-controlling agent, whereby a clear copy was obtained as in Example 4.

EXAMPLE 19

The test was conducted in the same manner as in Example 4 except that 4 parts of compound No. 24 was used instead of 3 parts of compound No. 1 as the charge-controlling agent, whereby a clear copy was obtained as in Example 4.

EXAMPLE 20

The test was conducted in the same manner as in Example 4 except that 3 parts of compound No. 27 was used instead of 3 parts of compound No. 1 as the charge-controlling agent, whereby a clear copy was obtained as in Example 4.

EXAMPLE 21

The test was conducted in the same manner as in Example 4 except that 2 parts of compound No. 28 was used instead of 3 parts of compound No. 1 as the charge-controlling agent, whereby a clear copy was obtained as in Example 4.

EXAMPLE 22

The test was conducted in the same manner as in Example 4 except that 3 parts of compound No. 29 was used instead of 3 parts of compound No. 1 as the charge-controlling agent, whereby a clear copy was obtained as in Example 4.

EXAMPLE 23

The test was conducted in the same manner as in Example 4 except that 3 parts of compound No. 30 was used instead of 3 parts of compound No. 1 as the charge-controlling agent, whereby a clear copy was obtained as in Example 4.

EXAMPLE 24

The test was conducted in the same manner as in Example 4 except that 3 parts of compound No. 31 was used instead of 3 parts of compound No. 1 as the charge-controlling agent, whereby a clear copy was obtained as in Example 4.

EXAMPLE 25

The test was conducted in the same manner as in Example 4 except that 4 parts of compound No. 33 was used instead of 3 parts of compound No. 1 as the charge-controlling agent, whereby a clear copy was obtained as in Example 4.

COMPARATIVE EXAMPLE 1

The developer was prepared in the same manner as in Example 4 except that compound No. 1 was not used as a material and subjected to actual copying, whereby a copy with substantial fogging and having a poor copied image quality, was obtained.

COMPARATIVE EXAMPLE 2

As a comparative compound, a compound of the following formula (V) was prepared, and its electric charge was compared with compound No. 36.

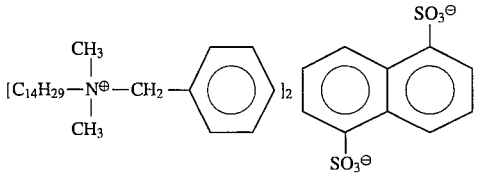

(V)

The electric charge was measured with respect to a sample having adjusted as follows.

A sample passed through 400 mesh was charged to a styrene-acrylate resin having an average particle size of 10 μm in a proportion of 1% by weight, and the mixture was blended by a mixer for 60 seconds. The mixture was mixed to an iron powder carrier having an average size of 100 μm in a proportion of 1% by weight, followed by shaking and stirring, whereupon the electric charge was measured by a blow off method. The results are shown below.

| Shaking time | Compound No. (36) 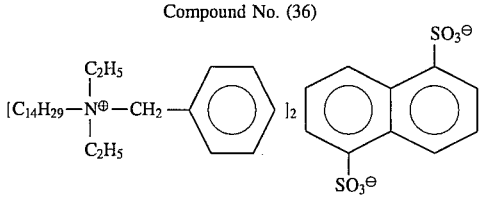 | Comparative compound (V) 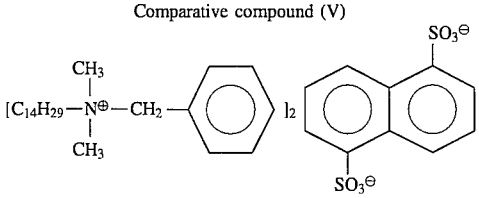 |
|---|---|---|
| 5 minutes | +30.0 μc/g | +25.0 μc/g |
| 10 minutes | +31.5 μc/g | +27.5 μc/g |
| 30 minutes | +32.2 μc/g | +28.3 μc/g |

From the above results, compound No. 36 was found to show better chargeability and have an electric charge which is higher by 20% than comparative compound (V). This indicates that compound No. 36 presents a clearer copy with better gradient.

COMPARATIVE EXAMPLE 3

As a comparative compound, a compound of the following formula (VI) was prepared, and its electric charge was compared with compound No. 8.

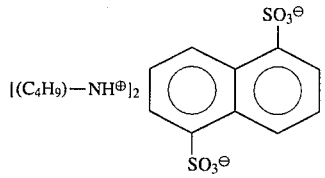

(VI)

The sample was adjusted in the same manner as in Comparative Example 2 except that a ferrite carrier was used instead of the iron powder carrier. The results are shown below.

| shaking time | Compound No. (8) | Comparative compound (VI) |
|---|---|---|
| 5 minutes | 16 μc/g | 6.5 μc/g |
| 10 minutes | 17.5 μc/g | 6 μc/g |
| 30 minutes | 15 μc/g | 5 μc/g |

From the above results., it was found that with comparative compound (VI), the electric charge was very low as compared with compound No. 8. This indicates that with comparative compound (VI), it is impossible to obtain a clear image free from fogging.

COMPARATIVE EXAMPLES 4 TO 10 AND EXAMPLES 26 AND 27

With respect to the compounds of the formula (I) wherein $R_1$ to $R_4$ are as identified in Table 2 and the moiety of the formula $$(A)\text{-}(SO_3^{\ominus})_2 \qquad (V)$$

is 1,5-naphthalenedisulfonic acid, the production efficiency, the properties, the melting points and the test results of thermalstability by DSC are shown in Table 2. The compounds of Comparative Examples 4 to 10 were poor in at least one of the above properties.

Compounds of the present invention similar to Comparative Examples are shown as Example 26 (Compound No. 5, the same compound as in Example 6) and Example 27 (Compound No. 7, the same compound as in Example 8), and they had no problem with respect to the above properties.

TABLE 2

| | $R_1$ | $R_2$ | $R_3$ | $R_4$ | Properties |
|---|---|---|---|---|---|
| Comparative Example 4 | $CH_3$ | $CH_3$ | $C_{12}H_{25}$ | $C_{12}H_{25}$ | Wax-like and impossible to be powdered |
| Comparative Example 5 | $CH_3$ | $CH_3$ | $C_4H_9$ | $C_4H_9$ | Insoluble in water, whereby it was difficult to recover by salt exchange. |
| Comparative Example 6 | $CH_3$ | $CH_3$ | $CH_3$ | $CH_3$ | Insoluble in water, whereby it was difficult to recover by salt exchange. |
| Comparative Example 7 | $CH_3$ | $CH_3$ | $CH_3$ | $C_{16}H_{33}$ | Very fine crystals, which required a long period of time for filtration. Futher, the thermal tability was poor. |
| Comparative Example 8 | $CH_3$ | $CH_3$ | $CH_3$ | $C_{18}H_{37}$ | In the measurement by DSC, heat generation was observed at 180° C.. |
| Comparative Example 9 | $CH_3$ | $CH_3$ | $-CH_2-$ 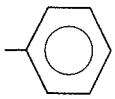 | $-CH_2-$ 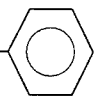 | Chargeability was poor. |
| Example 26 | $CH_3$ | $C_8H_{17}$ | $C_8H_{17}$ | $C_8H_{17}$ | Compound No. 5; white powder having a melting point of 190 to 192° C., and thermally stable by the measurement by DSC. |

TABLE 2-continued

| | $R_1$ | $R_2$ | $R_3$ | $R_4$ | Properties |
|---|---|---|---|---|---|
| Comparative Example 10 | 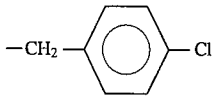 | $CH_3$ | $CH_3$ | $CH_3$ | Water-solubility was too high that it was difficult to prepare it constantly. |
| Example 27 | 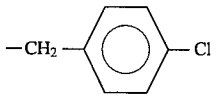 | $C_4H_9$ | $C_4H_9$ | $C_4H_9$ | Compound No. 7; white powder having a melting point of 213 to 215° C., and thermally stable by the measurement by DSC. |

COMPARATIVE EXAMPLE 11

A toner and a developer were prepared in the same manner as in Example 4 except that 2 parts of the stearyldimethylammonium 1,5-naphthalenedisulfonate was used as the charge-controlling agent. Then, actual copying was conducted in the same manner, whereby although the initial quality was good, the chargeability increased as the number of copied sheets increased, and it became impossible to obtain a copy of a good image quality.

COMPARATIVE EXAMPLE 12

The evaluation was conducted in the same manner as in Example 4 except that 2 parts of stearyltrimethylammonium 1,5-naphthalenedisulfonate (the same compound as used in Comparative Example 8) was used as the charge-controlling agent, whereby the chargeability increased with an increase of the number of the copied sheets, and it became impossible to obtain a copy with a good image quality.

COMPARATIVE EXAMPLE 13

The evaluation was conducted in the same manner as in Example 4 except that 2 parts of p-chlorobenzyltributyl ammonium naphthalene-1-sulfonate was used as the charge-controlling agent, whereby the chargeability was very poor, and it was impossible to obtain a copy with a satisfactory image quality. Further, even when the amount was increased to three parts, no improvement in the electric charge, was observed.

On the other hand, with the compound wherein the anion was changed to 1,5-naphthalenedisulfonic acid ion, a copy of a good image quality was obtained with excellent chargeability and stability of the electric charge, as shown in Example 8.

Now, the syntheses of the compounds of the formula (I) will be described in detail with reference to Preparation Examples.

PREPARATION EXAMPLE 1

Into a 3 l round bottom flask, 176.5 g of tri-n-butylamine and 200 ml of methyl alcohol were charged and heated to 65° C. with stirring. Then, 134.1 g of p-methylbenzyl chloride was added thereto over a period of one hour. Then, this solution was stirred at 65° C. for 10 hours. The heating was stopped, and the solution was cooled to 30° C. Then, 1113 ml of water and 82.4 g of toluene were added thereto, and the mixture was stirred at 30° C. for 30 minutes. Then, the toluene layer was removed to obtain an aqueous solution of tri-n-butyl-p-methylbenzylammonium chloride. To this aqueous solution, 0.3 g of $NaHCO_3$ was added to adjust the pH to 6.8.

1113 ml of water was added to 186.5 g of sodium 1,5-naphthalenedisulfonate, followed by heating to 50° C. To this aqueous solution, 3.5 g of $NaHCO_3$ was added to adjust the pH to 7.0. While maintaining this aqueous solution at 50° C. the above quaternary ammonium chloride solution was added thereto over a period of two hours. Simultaneously with the addition, white crystals precipitated. The reaction was continued for 1 hour, and then the reaction product was collected by filtration and washed four times with 1000 ml of water and then dried under 50 mmHg at 40° C. for 2 hours and then under 27 mmHg at 90° C. for 6 hours to obtain 315 g of tri-n-butyl-p-methylbenzylammonium 1,5-naphthalenedisulfonate (Compound No. 8) as a white powdery substance.

PREPARATION EXAMPLE 2

Into a 2 l round bottom flask, 33.3 g of tri-n-butyl amine and 20 ml of methyl alcohol were charged, and 31.9 g of p-chlorobenzyl chloride was further dropwise added thereto over a period of 5 minutes with stirring at room temperature (15°–25° C.). Then, this solution was stirred under heating at 60° C. The solution became viscous upon expiration of about 1 hour from the initiation of the heating.

The heating was stopped, and 210 ml of water and 20 g of chlorobenzene were added to the solution, and the mixture was stirred at 40° C. for 30 minutes. Then, the chlorobenzene layer was removed to obtain an aqueous solution of tri-n-butyl-p-chlorobenzylammonium chloride.

Then, to the aqueous solution of tri-n-butyl-p-chlorobenzylammonium chloride thus obtained, 35 g of sodium 1,5-naphthalenedisulfonate was added. Simultaneously with the addition, white crystals precipitated. The reaction was continued for 1 hour, and then the reaction product was collected by filtration. The product was washed twice with 200 ml of water and dried under 27 mmHg at 90° C. for 9 hours to obtain 65.6 g tri-n-butyl-p-chlorobenzylammonium 1,5-anphthalenedisulfonate (Compound No. 7) as a white powdery substance.

PREPARATION EXAMPLE 3

The synthesis was conducted in the same manner as in Preparation Example 2 except that 33.3 g of tri-n-butylamine was changed to 63.5 g of trioctylamine, 31.9 g of p-chlorobenzyl chloride was changed to 27.8 g of p-methylbenzyl chloride, and 20 g of chlorobenzene was changed to 8 g of toluene, whereby 84.2 g of tri-n-octyl-p-methylbenzylammonium 1,5-naphthalenedisulfonate (Compound No.38) was obtained as a white powdery substance.

We claim:

1. An electrostatic image-developing toner comprising at least a resin and a colorant, which further contains at least one compound of the following formula (I):

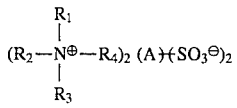

(I)

wherein $R_1$ is a substituted or unsubstituted aralkyl group, each of $R_2$, $R_3$ and $R_4$ is a $C_{2-24}$ substituted or unsubstituted alkyl group, and A is an aromatic ring residue which may have substituents.

2. The electrostatic image-developing toner according to claim 1, wherein $R_1$ is a benzyl group, a lower alkyl-substituted benzyl group, a nitro-substituted benzyl group, or a halogen-substituted benzyl group.

3. The electrostatic image-developing toner according to claim 1, wherein each of $R_2$, $R_3$ and $R_4$ is a $C_{2-24}$ alkyl group, a hydroxyl-substituted $C_{2-24}$ alkyl group, a halogen-substituted $C_{2-24}$ alkyl group, or an alkoxy-substituted $C_{2-24}$ group.

4. The electrostatic image-developing toner according to claim 1, wherein each of $R_2$, $R_3$ and $R_4$ is an unsubstituted $C_{2-16}$ alkyl group, or a hydroxyl-substituted $C_{2-8}$ alkyl group.

5. The electrostatic image-developing toner according to claim 1, wherein each of $R_2$, $R_3$ and $R_4$ is a $C_{2-12}$ alkyl group, and the difference in carbon number among $R_2$, $R_3$ and $R_4$ is not more than 4.

6. The electrostatic image-developing toner according to claim 1, wherein each of $R_2$, $R_3$ and $R_4$ are the same alkyl groups having from 2 to 12 carbon atoms.

7. The electrostatic image-developing toner according to claim 1, wherein each of $R_2$, $R_3$ and $R_4$ is a butyl group, an octyl group, a decyl group or a dodecyl group.

8. The electrostatic image-developing toner according to claim 1, wherein A is a benzene ring residue or a naphthalene ring residue, which is unsubstituted or substituted by a lower alkyl group, a hydroxyl group, an amino group or halogen atom.

9. The electrostatic image-developing toner according to claim 1, which comprises 100 parts by weight of the resin and from 0.1 to 20 parts by weight of the compound of the formula (I).

* * * * *